US008196418B2

(12) United States Patent
Kim et al.

(10) Patent No.: US 8,196,418 B2
(45) Date of Patent: Jun. 12, 2012

(54) SENSING METHOD OF WATER FOR MAKING ICE IN REFRIGERATOR

(75) Inventors: Young Jin Kim, Seoul (KR); Seung Hwan Oh, Kunpo-si (KR)

(73) Assignee: LG Electronics Inc., Seoul (KR)

( * ) Notice: Subject to any disclaimer, the term of this patent is extended or adjusted under 35 U.S.C. 154(b) by 601 days.

(21) Appl. No.: 12/377,006

(22) PCT Filed: Aug. 10, 2007

(86) PCT No.: PCT/KR2007/003847

§ 371 (c)(1),
(2), (4) Date: Feb. 10, 2009

(87) PCT Pub. No.: WO2008/018770

PCT Pub. Date: Feb. 14, 2008

(65) Prior Publication Data

US 2010/0161137 A1 Jun. 24, 2010

(30) Foreign Application Priority Data

Aug. 11, 2006 (KR) ..... 10-2006-0076248

(51) Int. Cl.
*F25C 1/00* (2006.01)

(52) U.S. Cl. ..... 62/127; 62/233

(58) Field of Classification Search ..... 62/66, 127, 62/129, 233, 340

See application file for complete search history.

(56) References Cited

U.S. PATENT DOCUMENTS

| | | | | |
|---|---|---|---|---|
| 5,090,210 | A * | 2/1992 | Katayanagi et al. | 62/135 |
| 6,092,374 | A * | 7/2000 | Kang et al. | 62/74 |
| 7,100,379 | B2 * | 9/2006 | Son et al. | 62/74 |

FOREIGN PATENT DOCUMENTS

| | | |
|---|---|---|
| JP | 01-234772 | 9/1989 |
| JP | 07-043057 | 2/1995 |
| KR | 10-1997-0022172 | 5/1997 |

OTHER PUBLICATIONS

International Search Report dated Nov. 6, 2007.

* cited by examiner

*Primary Examiner* — Marc Norman
(74) *Attorney, Agent, or Firm* — Ked & Associates LLP

(57) ABSTRACT

Provided is a method for sensing ice-making water in a refrigerator. The method includes activating a pump to move water from a water tank to an ice-making chamber; comparing a temperature of the ice-making chamber with an ice-making reference temperature set; when the temperature of the ice-making chamber is equal to the ice-making reference temperature, calculating an ice-making consumption time until the ice-making reference temperature after the activating of the pump; comparing the ice-making consumption time with an ice-making reference time set; and when the ice-making consumption time is smaller than the ice-making reference time, determining that there is no water in the water tank.

19 Claims, 5 Drawing Sheets

[Fig. 1]
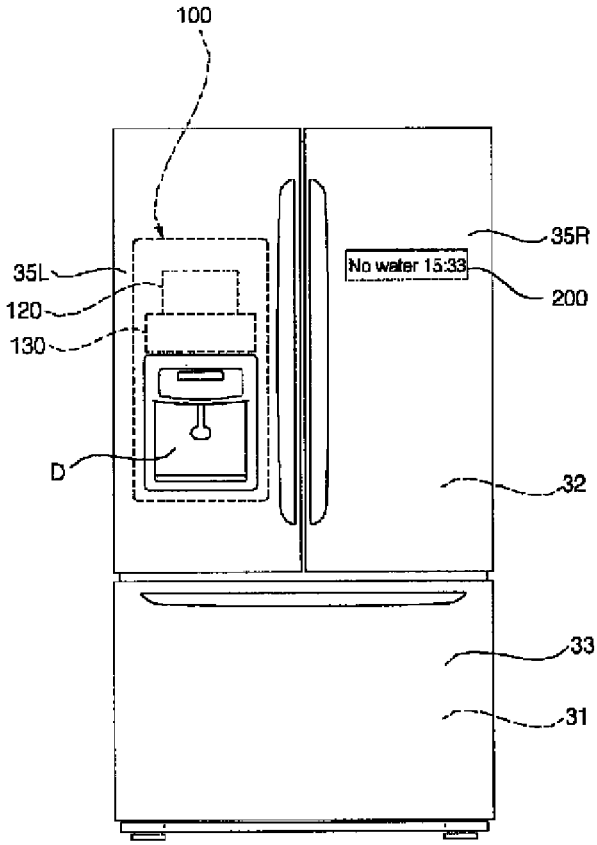
[Fig. 2]
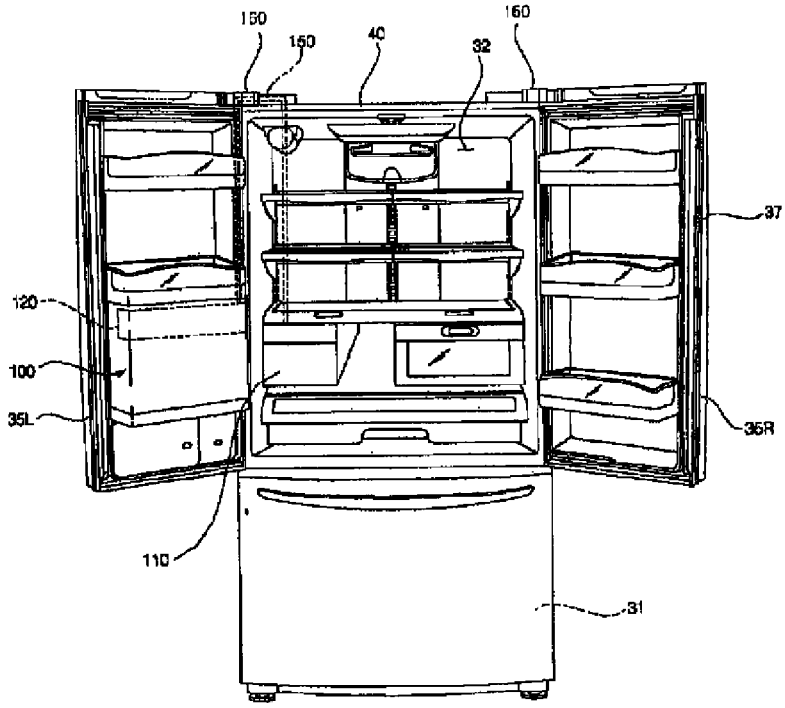

[Fig. 3]
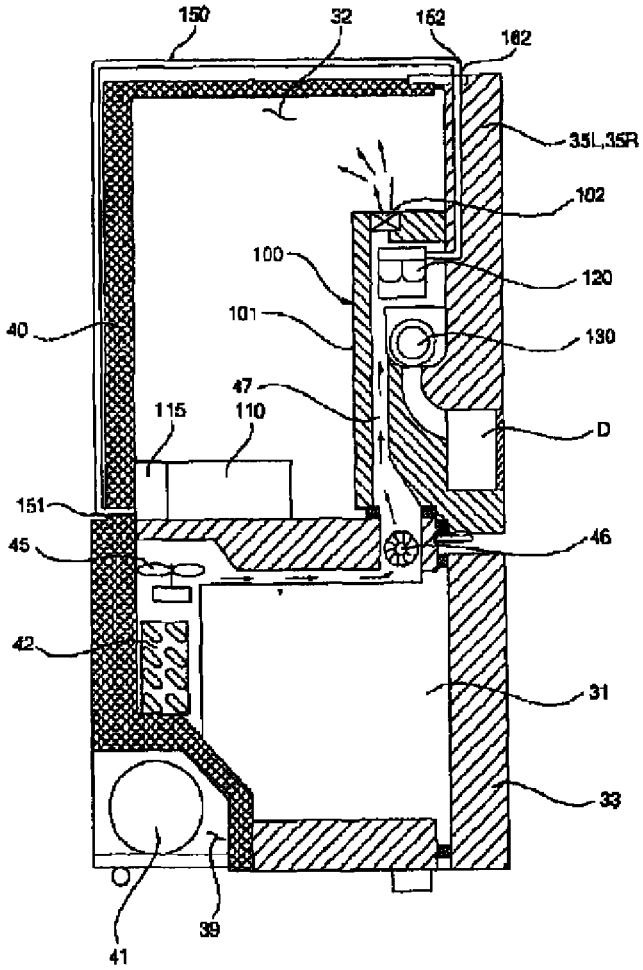
[Fig. 4]
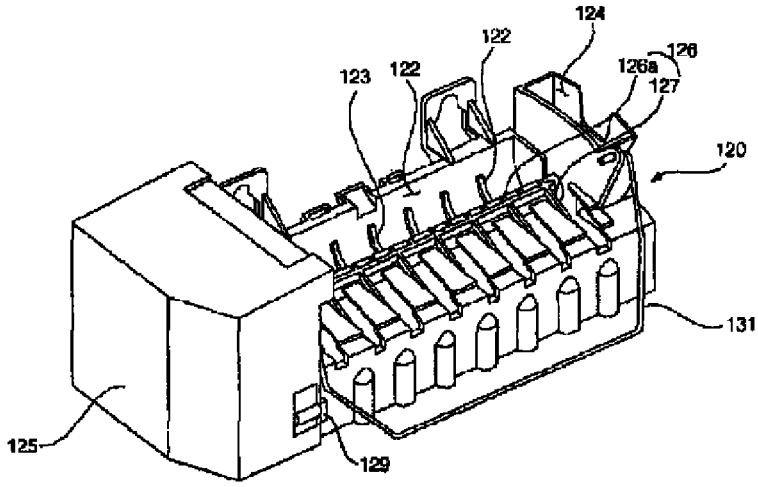

[Fig. 5]
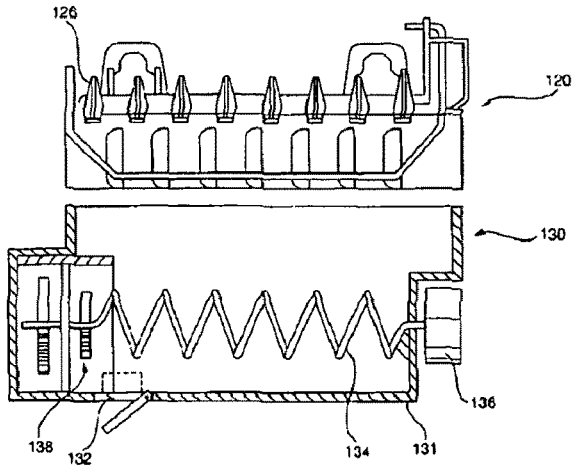
[Fig. 6]
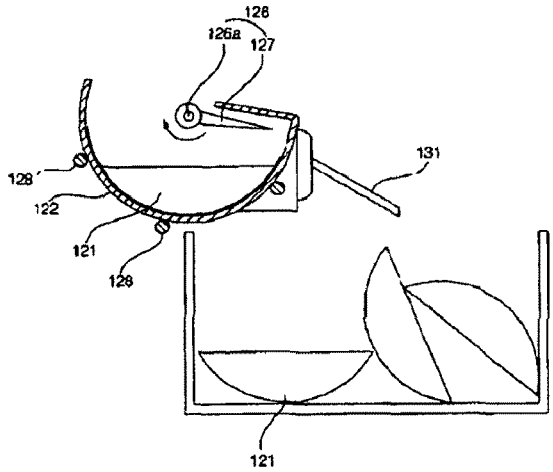
[Fig. 7]
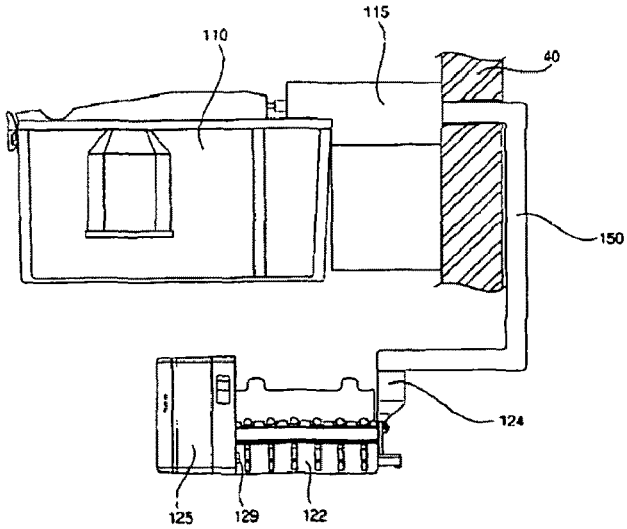

[Fig. 8]
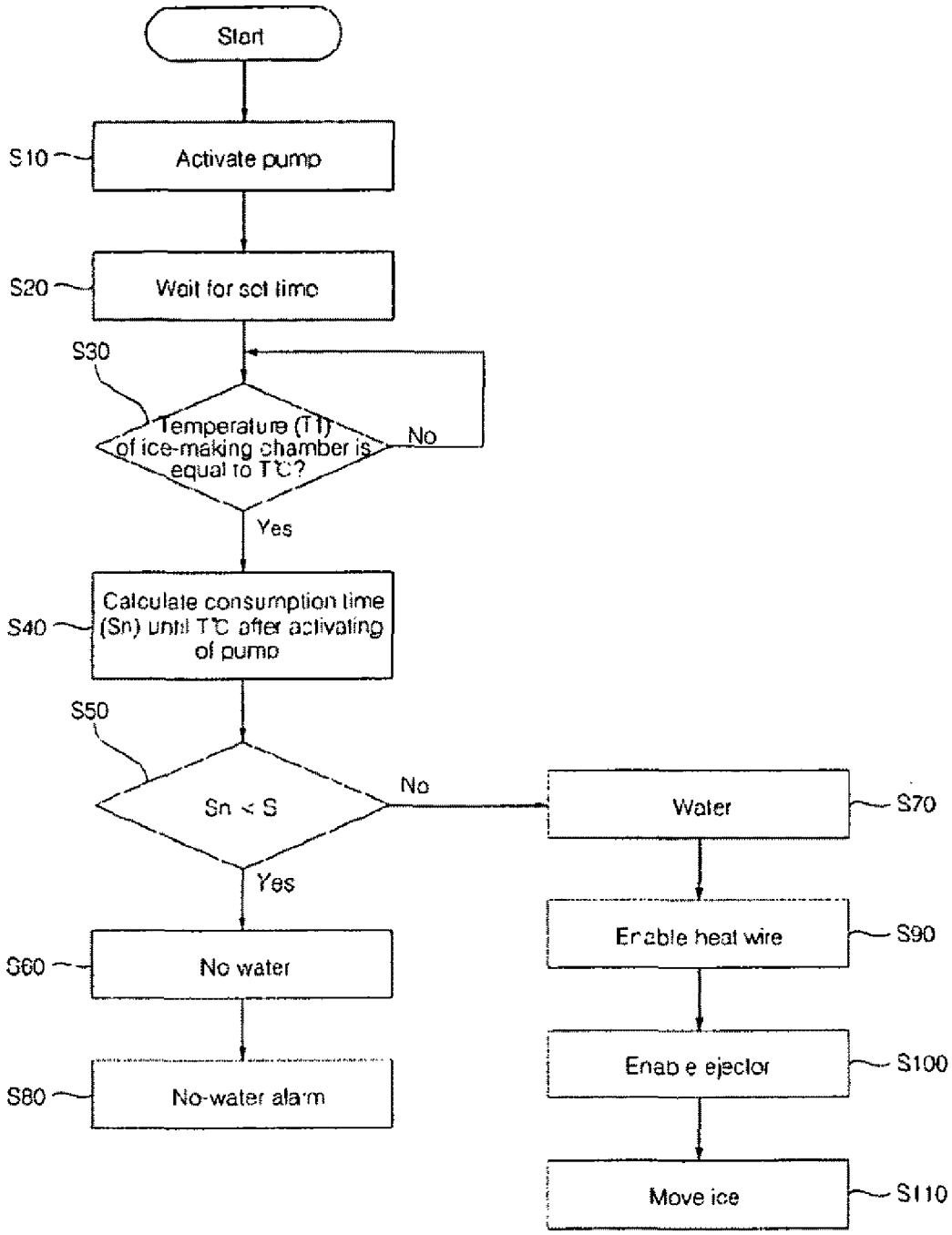

[Fig. 9]
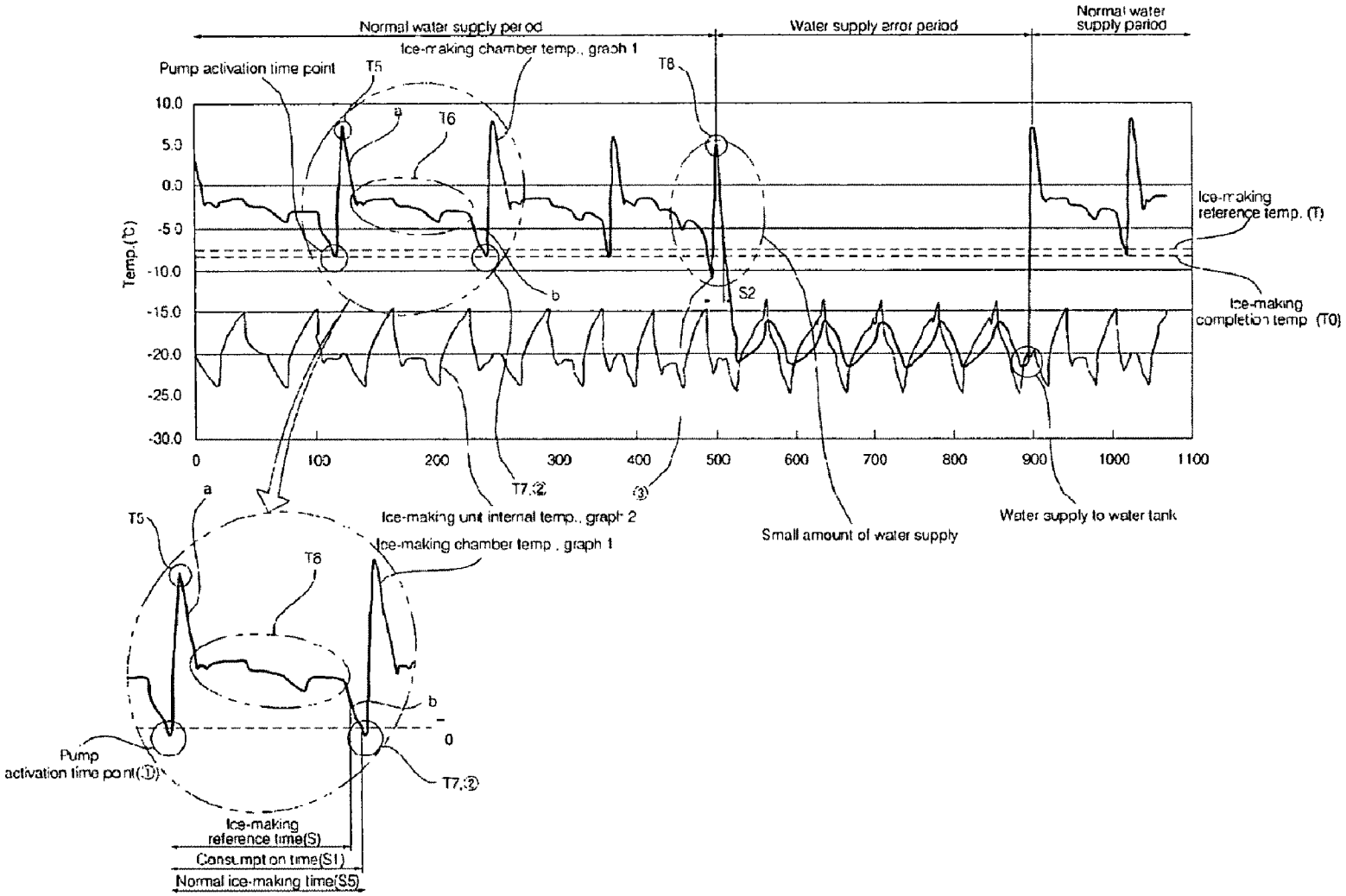

SENSING METHOD OF WATER FOR MAKING ICE IN REFRIGERATOR

TECHNICAL FIELD

The present invention relates to a method for controlling a refrigerator equipped with an ice-making unit, and more particularly, to a method for sensing the presence and absence of ice-making water.

BACKGROUND ART

In conventional refrigerators, an ice-making unit includes an ice machine for making pieces of ice; an ice bank for storing the pieces of ice made by the ice machine; a water tank for storing water supplied to the ice machine; and a pump for supplying water of the water tank to the ice machine.

However, there is a drawback that the conventional refrigerators lead to a reduction of refrigeration efficiency because the pump operates in an idle state even when there is no water in the water tank.

DISCLOSURE OF INVENTION

Technical Problem

Accordingly, the present invention is to solve at least the problems and disadvantages of the background art.

The present invention is to provide a method for sensing ice-making water in a refrigerator, for simply and conveniently sensing the presence and absence of water with accuracy, in a water tank to store water supplied to a chilling chamber of a refrigerator.

Technical Solution

To achieve these and other advantages and in accordance with the purpose of the present invention, as embodied and broadly described, there is provided a method for sensing ice-making water in a refrigerator. The method includes activating a pump to move water from a water tank to an ice-making chamber; comparing a temperature of the ice-making chamber with an ice-making reference temperature set; when the temperature of the ice-making chamber is equal to the ice-making reference temperature, calculating an ice-making consumption time until the ice-making reference temperature after the activating of the pump; comparing the ice-making consumption time with an ice-making reference time set; and when the ice-making consumption time is smaller than the ice-making reference time, determining that there is no water in the water tank.

The method may further include waiting for a set time after the pump is activated or determining that there is water in the water tank when the ice-making consumption time is equal or more than the ice-making reference time.

The ice-making reference temperature is a temperature at which water of the ice-making chamber is phase-transited to ice at more than a predetermined rate, and particularly, is set higher than an ice-making completion temperature at which all water of the ice-making chamber is phase-transited to ice.

The ice-making reference time is set as an ice-making consumption time from the time the pump is activated to a time expected to be taken for water of the ice-making chamber to be phase-transited to ice at more than a predetermined rate in a normal condition.

Specifically, the refrigerator further includes an ice bank storing the ice, and the ice-making reference time is set less than a normal ice-making time of one cycle for which water is supplied to the ice-making chamber, the supplied water is phase-transited to ice, the phase-transited ice is moved to an ice bank, and water is again supplied to the ice-making chamber from which the ice moves.

Advantageous Effects

A method for sensing ice-making water in a refrigerator according to the present invention compares an ice-making reference time (S) set from an expectation to be taken until a temperature of an ice-making chamber drops to an ice-making reference temperature in a normal condition with an ice-making consumption time (Sn) for which the temperature of the ice-making chamber really drops to the ice-making reference temperature, determines that there is water in the water tank when the ice-making consumption time (Sn) is equal or more than the ice-making reference time (S), and determines that there is no water in the water tank when the ice-making consumption time (Sn) is less than the ice-making reference time (S). Therefore, there is an effect of determining the presence or absence of water stored in a water tank with accuracy.

BRIEF DESCRIPTION OF THE DRAWINGS

The invention will be described in detail with reference to the following drawings in which like numerals refer to like elements.

FIG. 1 is a front view illustrating a refrigerator according to the present invention;

FIG. 2 is a front view illustrating an interior of a refrigerator according to the present invention;

FIG. 3 is a cross section illustrating an interior of a refrigerator according to the present invention;

FIG. 4 is a perspective view illustrating an ice machine of a ice-making unit according to the present invention;

FIG. 5 is a cross section illustrating an ice machine and an ice bank of an ice-making unit according to the present invention;

FIG. 6 is a cross section illustrating an ice-making unit according to the present invention;

FIG. 7 is a schematic view illustrating an ice-making unit according to the present invention;

FIG. 8 is a flowchart illustrating a method for sensing ice-making water in a refrigerator according to the present invention; and FIG. 9 is a graph showing temperature variation versus time in a chilling chamber according to the present invention.

BEST MODE FOR CARRYING OUT THE INVENTION

Preferred embodiments of the present invention will be described in a more detailed manner with reference to the drawings.

FIG. 1 is a front view illustrating a refrigerator according to the present invention. FIG. 2 is a front view illustrating an interior of the refrigerator according to the present invention. FIG. 3 is a cross section illustrating the interior of the refrigerator according to the present invention.

As shown in FIGS. 1 to 3, the refrigerator is divided into a freezing chamber 31 positioned at bottom side and a chilling chamber 32 positioned at top side and equipped with two-door type doors 35L and 35R.

The both-side doors 35L and 35R are configured to connect to a main body 40 of the refrigerator by a hinge unit 160, opening and closing the freezing chamber 32.

Gaskets 37 are installed at up/down and left/right sides of the both-side doors 35L and 35R such that they are closely adhered to the main body 40 to prevent leakage of a cold air.

A freezing chamber door 33 is installed in front of the freezing chamber 31. The freezing chamber door 33 rotates to the front about the main body 40 while opening and closing the freezing chamber 31.

As shown in FIG. 3, the refrigerator includes the main body 40 partitioned into the freezing chamber 32, the freezing chamber 31, and a machine chamber 39; and the doors 35L, 35R and 33 for opening and closing the chilling chamber 32 and the freezing chamber 31, respectively.

The refrigerator includes a compressor 41 installed in the machine chamber 39; a condenser (not shown) for receiving a refrigerant from the compressor 41 and condensing the refrigerant; and an evaporator 42 positioned in the freezing chamber 31 and evaporating the condensed refrigerant. An ice-making unit 100 making pieces of ice is installed in the chilling chamber 32.

The refrigerant evaporated by the evaporator 42 is heat-exchanged with an internal air of the freezing chamber 31, and the heat-exchanged air is supplied to the freezing chamber 31, the chilling chamber 32, and the ice-making unit 100.

For this, the main body 40 is equipped with a blower 45 and an ice-making blower 46. A freezing chamber channel (not shown), a chilling chamber channel (not shown), and an ice-making channel 47 are installed within the main body 40. The blower 45 blows an air cooled in the evaporator 42 to the chilling chamber 32, the freezing chamber 31, and the ice-making unit 100. The ice-making blower 46 blows part of the air blown by the blower 45 to the ice-making unit 100 or the chilling chamber 32. The freezing chamber channel (not shown) and the chilling chamber channel (not shown) are to allow a flow of the heat-exchanged cold air to the freezing chamber 31 or the chilling chamber 32 by the blower 45. The ice-making channel 47 is to allow a flow of the heat-exchanged cold air to the ice-making unit 100.

The ice-making blower 46 is installed in the ice-making channel 47 to blow a cold air blown by the blower 45 to the ice-making unit 100.

Particularly, the ice-making unit 100 is installed in the chilling chamber 32. The ice-making unit 100 is separated from the chilling chamber 32 by an adiabatic case 101 to prevent a cold air within the ice-making unit 100 from leaking in the chilling chamber 32.

The adiabatic case 101 is equipped with a damper 102. A controller of the refrigerator controls the damper 102 to discharge part of a cold air within the ice-making unit 100 to the chilling chamber 32.

FIG. 4 is a perspective view illustrating the ice machine of the ice-making unit according to the present invention. FIG. 5 is a cross section illustrating the ice machine and the ice bank of the ice-making unit according to the present invention. FIG. 6 is a cross section illustrating the ice-making unit according to the present invention. FIG. 7 is a schematic view illustrating the ice-making unit according to the present invention.

As shown in FIGS. 4 to 7, the ice-making unit 100 includes the adiabatic case 101 installed at the door 35L of the chilling chamber 32 and separated from the chilling chamber 32; a water tank 110 installed in the chilling chamber 32; the ice machine 120 for receiving water from the water tank 110 and making pieces of ice; the ice bank 130 for storing the pieces of ice made by the ice machine 120; and a dispenser (D) for discharging the pieces of ice from the ice bank 130 outside the refrigerator.

The ice machine 120 includes an ice-making chamber 122 in which ice is made; and a water supply unit 124 installed at one side of the ice-making chamber 122 and supplying water to the ice-making chamber 122. The water supply unit 124 is connected with the water tank 110.

A pump 115 is installed between the water tank 110 and the water supply unit 124. The pump 115 can pump and transfer water from the water tank 110 to the water supply unit 124. Alternately, the pump 115 can move water from the water tank 110 to the water supply unit 124 by a water head stored in the water tank 110.

The pump 115 is connected with the ice-making chamber 122 through a connection duct 150 to supply stored water from the water tank 110 to the ice-making chamber 122.

One end 151 of the connection duct 150 passes through the main body 40 and the other end 152 passes through a top hinge 162 of the door 35L. Thus, the connection duct 150 connects to the ice-making chamber 122.

Specifically, the other end 152 of the connection duct 150 is installed at the top hinge 162 that is a rotation center of the door 35L. Thus, even when the door 35L is opened/closed, a movement of the other end 152 depending on the opening/closing is minimized.

The ice-making chamber 122 is of an approximate semi-cylindrical shape. Partition ribs 123 are configured to upwardly protrude every interval for ice separation in the ice-making chamber 122.

A motor unit 125 is installed at one side of the ice-making chamber 122. A motor (not shown) is built in the motor unit 125. An ejector 126 is rotatably connected to a rotary shaft of the motor.

A temperature sensor 129 is installed at one side of the ice-making chamber 122 to sense a temperature of the ice-making chamber 122. The controller of the refrigerator controls the ice-making unit 120 depending on sense data from the temperature sensor 129.

The ejector 126 is installed such that a rotary shaft 126*a* traverses a central space of the ice-making chamber 122. A plurality of ejector pins 126*b* are spaced a distance apart from each other on the rotary shaft 126*a* of the ejector 126 in a direction of crossing at right angles with the rotary shaft 126*a*. Each of the ejector pins 126*b* is disposed between the partition ribs 123.

The ejector 126 is rotated by the motor unit 125, centering on the rotary shaft 126*a*. As the ejector 126 rotates, the ejector pin 126*a* discharges pieces of ice, which is made at the partition rib 123 of the ice-making chamber 122, to the ice bank 130.

A heater 128 is disposed at a bottom surface of the ice-making chamber 122. The heater 128 heats a surface of the ice-making chamber 122 for a short time and slightly melts a surface of ice 121 within the ice-making chamber 122, thereby facilitating a separation of the ice 121 from the ice-making chamber 122.

An ice-full sensing arm 127 is installed at the ice machine 120 to sense an amount of ice filled in the ice bank 130. The ice-full sensing arm 127 is movable up/down. The ice-full sensing arm 127 connects to a controller built in the motor unit 125 and senses a maximum amount of ice stored in the ice bank 130.

The ice bank 130 is opened at a top surface to house pieces of ice falling and has an ice outlet 132 at a bottom surface.

The ice bank 130 includes a housing 131 in which ice is stored, an ice transfer unit 134, a motor 136, an ice crusher 138, and an ice discharger 135.

The ice transfer unit 134 is of a screw shape and is installed to traverse an internal space of the housing 131. The ice transfer unit 134 is rotatably coupled to the motor 136 by a shaft.

As the motor 136 rotates, the ice transfer unit 134 rotates while moving the ice 121 to the ice crusher 138.

The ice outlet 132 is disposed under the ice crusher 138. An ice discharger 140 is installed at the ice bank 130.

The ice discharger 140 includes a shutter 141 and a solenoid 142. The shutter 141 is installed at the ice outlet 132 of the housing 131. The shutter 141 opens and closes the ice outlet 132 by the solenoid 142.

FIG. 8 is a flowchart illustrating a method for sensing ice-making water in the refrigerator according to the present invention. FIG. 9 is a graph showing temperature variation versus time in the chilling chamber according to the present invention.

As shown in FIGS. 8 and 9, a method for controlling the ice-making unit of the refrigerator according to the present invention includes a step of activating the pump 115 (S10); a step of waiting for a set time after the pump 115 is activated (S20); a step of comparing a temperature (T1) of the ice-making chamber 122 with an ice-making reference temperature (T) by the temperature sensor 129 installed at the ice-making chamber 122 (S30); a step of, when the temperature (T1) of the ice-making chamber 122 is equal to the ice-making reference temperature (T), calculating an ice-making consumption time (Sn) until the ice-making reference temperature (T) after the pump 115 is activated (S40); a step of comparing the ice-making consumption time (Sn) with an ice-making reference time (S) stored in the controller of the refrigerator (S50); a step of, when the ice-making consumption time (Sn) is less than the ice-making reference time (S), determining that there is 'no water' in the water tank 110 (S60); and a step of, when the ice-making consumption time (Sn) is equal or more than the ice-making reference time (S), determining that there is 'water' in the water tank 110 (S70).

The pump activating step (S10) is a step of activating the pump 115 by the controller. When there is water stored in the water tank 110, the water of the water tank 110 is supplied to the ice-making chamber 122 via the pump 115. Unlike this, when there is no water in the water tank 110, no water is supplied to the ice-making chamber 122 even when the pump 115 is activated.

Thus, in the pump activating step (S10), the pump 115 is activated by the controller irrespective of the presence or absence of water stored in the water tank 110.

The set-time waiting step (S20) is to skip such that the temperature sensor 129 does not sense the ice-making reference temperature (T) when water is normally supplied to the ice-making chamber 122 and a temperature of the ice-making chamber 122 increases.

In detail, the temperature (T1) of the ice-making chamber 122 increases beyond the ice-making reference temperature (T) when the ice-making chamber 122 is supplied with water and rapidly increases in temperature. The temperature (T1) of the ice-making chamber 122 goes through the ice-making reference temperature (T) when increasing or decreasing. In the set-time waiting step (S20), the temperature sensor 129 is not allowed to sense a temperature for a predetermined time after the activating of the pump 115 such that when the ice-making chamber 122 increases in temperature, the ice-making reference temperature (T) is not detected.

In the ice-making reference temperature (T) comparing step (S30), the temperature (T1) of the ice-making chamber 122 sensed by the temperature sensor 129 is compared with the ice-making reference temperature (T). The ice-making reference temperature (T) comparing step (S30) is to check whether the temperature (T1) of the ice-making chamber 122 drops to the ice-making reference temperature (T).

The ice-making reference temperature (T) is a set temperature stored in the controller.

An ice-making completion temperature (T0) is a temperature at which water stored in the ice-making chamber 122 is completely converted into ice. The ice-making completion temperature (T0) is a value set by experiment, varying depending on a volume of the ice-making chamber 122. The ice-making completion temperature (T0) may be set equally to the ice-making reference temperature (T) but, in the present exemplary embodiment, is set higher than the ice-making reference temperature (T) and stored in the controller.

The ice-making consumption time calculating step (S40) is a step of calculating an ice-making consumption time (Sn) until the temperature (T1) of the ice-making chamber 122 is equal to the ice-making reference temperature (T) after the pump 115 is activated. The controller determines the presence or absence of water stored in the water tank 110 on the basis of the ice-making consumption time (Sn).

In the ice-making reference time comparing step (S50), the controller compares the ice-making consumption time (Sn) with the ice-making reference time (S) in size.

The ice-making reference time (S) is a time taken until the temperature of the ice-making chamber 122 is equal to the ice-making reference temperature (T) after the ice-making chamber 122 is supplied with a regular amount of water. The ice-making reference time (S) is an experimental value stored in the controller.

The controller determines that water of an amount less than a normal tolerance range or no water has been supplied to the ice-making chamber 122 when the comparison result of the ice-making reference time comparing step (S50) is that the ice-making consumption time (Sn) is smaller than the ice-making reference time (S).

In other words, when the ice-making chamber 122 is supplied with no water, the ice-making chamber 122 rapidly decreases in temperature while reaching the ice-making reference temperature (T) because no water is heat exchanged with a cold air.

In the case of no water, the ice-making consumption time (Sn) taken for the ice-making chamber 122 to reach the ice-making reference temperature (T) gets smaller than the ice-making reference time (S), and the controller determines that there is no water in the water tank 110 (S60).

When determining that there is no water (S60), the controller informs no-water via a speaker (not shown) installed at the refrigerator or displays 'no water' on a display unit 200 (S80).

When the comparison result of the ice-making reference time comparing step (S50) is that the ice-making consumption time (Sn) is equal or more than the ice-making reference time (S), the controller determines that there is sufficient water in the water tank 110 (S70).

Thus, when determining that there is sufficient water in the water tank 110, the controller enables a heat wire 128 installed under the ice-making chamber 122 to melt part of a bottom surface of the ice 121 (S90) and enables the ejector 126 (S100) to move the ice 121 to the ice bank 130 (S110).

Generally, a temperature of the ice-making unit is higher than a temperature of the freezing chamber. Therefore, when the temperature of the ice-making unit is equal to the temperature of the freezing chamber, the controller can determine that there is no water in the water tank and sense no-water with more accuracy.

A method for controlling the ice-making unit in the refrigerator will be described in detail with reference to FIG. 9 below.

In FIG. 9, an upper graph 1 shows a variation of a temperature of the ice-making chamber 122 sensed by the temperature sensor 129 of the ice-making chamber 122. A lower graph 2 shows a variation of a temperature within the freezing chamber 31 or the ice-making unit 120.

"Sn" of FIG. 8 is the same as "S1" and "S2" of FIG. 9. The ice-making reference temperature (T1) and the ice-making reference time (S) are values set through experiment.

The ice-making chamber 122 reacts dependently on a variation of a temperature of the freezing chamber 31 and has a higher temperature than the freezing chamber 31, because being supplied with a cold air of the freezing chamber 31.

Referring to the graph 1 of FIG. 9, ① denoting a pump activation time point appears when water stored in the water tank 110 is normally supplied to the ice-making chamber 122 via the pump 115.

In other words, if water is normally supplied to the ice-making chamber 122, the supplied water is heat exchanged with the ice-making chamber 122. Thus, a temperature of the ice-making chamber 122 abruptly increases.

Next, a peak temperature (T5) of the ice-making chamber 122 again abruptly drops because of a cold air supplied. The ice-making chamber 122 has an abrupt temperature drop slope (a) because the supplied water is cooled in a liquid state.

The low-temperatured water gradually decreases in temperature without a sudden variation of temperature during a predetermined time (T6). This is because the low-temperatured water absorbs heat during a phase transition from liquid to solid.

The ice 121 completing a phase transition to solid in the ice-making chamber again drops in temperature along an abrupt temperature drop slope (b), reducing to an ice-making completion temperature (T0) lower than the ice-making reference temperature (T).

The controller determines that there is water in the water tank 110, moves pieces of made ice to the ice bank 130, and again activates the pump 115, when an ice-making consumption time (S1) from the pump activation time point (①) to the ice-making reference temperature (T) is equal or more than an ice-making reference time (S).

The ice-making reference time (S) is set slightly smaller than a normal ice making time. This is to consider a water supply error caused by the pump 115 or an error caused by a temperature of a cold air supplied from the freezing chamber 31.

That the ice-making reference time (S) is smaller than a normal ice-making time (S5) is to make pieces of ice even when water supplied from the water tank 110 is insufficient by a predetermined amount and move the made pieces of ice to the ice bank 130.

A temperature of the ice-making chamber 122 at a pump re-activation time point (②) is equal to the lowest temperature (T7) during an ice-making procedure, and abruptly increases as the ice-making chamber 122 is again supplied with water from the pump 115. Thus, ice-making is repeatedly performed.

A description of a temperature variation of the ice-making chamber 122 in a water supply error period in the case of no water or a small amount of water supplied will be made below.

When a small amount of water is supplied to the ice-making chamber 122 by an activation of the pump 115 (③), the small amount of supplied water leads to an abrupt increase of a temperature of the ice-making chamber 122. A peak temperature (T8) abruptly increasing by the small amount of supplied water is lower than a peak temperature (T5) increasing by normal water supply.

After being supplied with the small amount of water, the ice-making chamber 122 abruptly drops in temperature and reaches the ice-making reference temperature (T).

An ice-making consumption time (S2) for which the ice-making chamber 122 reaches the ice-making reference temperature (T) after pump activation is less than the ice-making reference time (S). The controller determines that there is no water in the water tank 110 and displays 'no water' on the display unit 200 of the refrigerator in place of enabling the heat wire 128 and the ejector 126, because the ice-making consumption time (S2) is shorter than the ice-making reference time (S).

If the ice-making chamber 122 is supplied with a small amount or no water, it takes a short time for the ice-making chamber 122 to reach the ice-making reference temperature (T) because it takes a short time to heat-exchange the supplied water with a cold air or takes no time.

After that, the controller displays 'no water' on the display unit 200 until the water tank 110 is supplied with water.

If the water tank 110 is filled with water by a user, a normal temperature variation appears as shown.

The present invention exemplifies a refrigerator whose freezing chamber is disposed under a main body, but this is a mere example and is applicable to all kinds of refrigerators equipped with an ice-making unit. The present invention is applicable by those skilled in the art within the scope and spirit of the invention without a limitation to an exemplary embodiment and drawings disclosed in this specification.

INDUSTRIAL APPLICABILITY

A method for sensing ice-making water in a refrigerator according to the present invention compares an ice-making reference time (S) for which a temperature of an ice-making chamber drops to an ice-making reference temperature with an ice-making consumption time (Sn) for which the temperature of the ice-making chamber really drops to the ice-making reference temperature, determines that there is water in the water tank when the ice-making consumption time (Sn) is equal or more than the ice-making reference time (S), and determines that there is no water in the water tank when the ice-making consumption time (Sn) is less than the ice-making reference time (S). Therefore, there is an effect of determining the presence or absence of water stored in a water tank with accuracy.

Also, a method for sensing ice-making water in a refrigerator according to the present invention determines the presence or absence of water stored in the water tank by a temperature sensor installed at the refrigerator. Therefore, there is an effect of construction simplification and cost saving owing to the non-use of a separate sensor.

Also, a method for sensing ice-making water in a refrigerator according to the present invention uses an ice-making consumption time (Sn) as a variable for sensing the presence or absence of water stored in the water tank. Therefore, there is an effect of more surely determining the presence or absence of water stored.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A method for sensing ice-making water in a refrigerator, the method comprising:

activating a pump to move water from a water tank to an ice-making chamber;

comparing a temperature of the ice-making chamber with an ice-making reference temperature;

when the temperature of the ice-making chamber is equal to the ice-making reference temperature, calculating an ice-making consumption time until the ice-making reference temperature is reached after the activating of the pump;

comparing the ice-making consumption time with an ice-making reference time set; and when the ice-making consumption time is smaller than the ice-making reference time, generating an alarm signal to indicate that no water or an insufficient amount of water is in the water tank.

2. The method of claim 1, further comprising: waiting for a set time after the pump is activated and then comparing the temperature of the ice-making chamber with the ice-making reference temperature.

3. The method of claim 1, further comprising: determining that there is water in the water tank when the ice-making consumption time is equal to or more than the ice-making reference time.

4. The method of claim 1, wherein the ice-making reference temperature is set higher than an internal temperature of a freezing chamber.

5. The method of claim 1, wherein the ice-making reference temperature is a temperature at which water of the ice-making chamber is phase-transited to ice at more than a predetermined rate.

6. The method of claim 5, wherein the ice-making reference temperature is set higher than an ice-making completion temperature at which all water of the ice-making chamber is phase-transited to ice.

7. The method of claim 6, wherein the ice-making completion temperature is set higher than an internal temperature of a freezing chamber.

8. The method of claim 1, further comprising:

determining that there is no water or an insufficient amount of water is in the water tank when a temperature of the freezing chamber is equal to a temperature of an ice-making unit.

9. The method of claim 1, wherein the ice-making reference time is set as an ice-making consumption time from the time the pump is activated to a time at which water of the ice-making chamber is phase-transited to ice at more than a predetermined rate.

10. The method of claim 1, wherein the ice-making reference time is set less than a predetermined ice-making time of one cycle for which water is supplied to the ice-making chamber, the supplied water is phase-transited to ice, the phase-transited ice is moved to an ice bank, and water is again supplied to the ice-making chamber from which the ice moves.

11. The method of claim 1, further comprising:

displaying information on a display unit indicating that no water or an insufficient amount of water is in the water tank.

12. The method of claim 1, further comprising:

outputting the alarm signal through a speaker to indicate that no water or an insufficient amount of water is in the water tank.

13. A refrigerator comprising:

a controller;

a water tank to store water;

an ice maker including an ice-making chamber in which pieces of ice are made and a water supply unit to supply water to the ice-making chamber;

a pump to move water from the water tank to the water supply unit;

an ice bank to store the pieces of ice made by the ice maker;

a dispenser to discharge the pieces of ice from the ice bank; and an alarm indicator to output an alarm when no water or an insufficient amount of water is in the water tank, the alarm output when the controller determines that an ice-making consumption time is smaller than an ice-making reference time, wherein the controller is configured to:

compare a temperature of the ice-making chamber with a predetermined ice-making reference temperature;

when the temperature of the ice-making chamber is equal to the predetermined ice-making reference temperature, calculate the ice-making consumption time until the ice-making reference temperature after the pump is activated; and compare the ice-making consumption time with the ice-making reference time, wherein the controller determines that the ice-making consumption time is smaller than the ice-making reference time based on said comparison.

14. The refrigerator of claim 13, wherein the alarm indicator includes a display unit and wherein the alarm includes displaying information on the display unit indicating that no water or an insufficient amount of water is in the water tank.

15. The refrigerator of claim 13, wherein the alarm indicator includes a speaker and wherein the alarm includes outputting an alarm signal through the speaker to indicate that no water or an insufficient amount of water is in the tank.

16. A refrigerator comprising:

a water tank to store water;

an ice maker including an ice-making chamber in which pieces of ice are made and a water supply unit to supply water to the ice-making chamber; and a pump to move water from the water tank to the water supply unit, and a controller configured to:

compare a temperature of the ice-making chamber with an ice-making reference temperature, calculate an ice-making consumption time until the ice-making reference temperature is reached after the pump is activated when the temperature of the ice-making chamber is equal to the ice-making reference temperature, compare the ice-making consumption time with an ice-making reference time, and generate a control signal to perform a predetermined function in the refrigerator when the ice-making consumption time is less than the ice-making reference time.

17. The refrigerator of claim 16, wherein the predetermined function includes generating an alarm to indicate that no water or an insufficient amount of water is in the tank.

18. The refrigerator of claim 16, wherein the alarm includes displaying information on a display unit indicating that no water or an insufficient amount of water is in the water tank.

19. The refrigerator of claim 16, wherein the includes outputting an alarm signal through the speaker to indicate that no water or an insufficient amount of water is in the tank.

* * * * *